US006453501B1

(12) United States Patent
Bella

(10) Patent No.: US 6,453,501 B1
(45) Date of Patent: Sep. 24, 2002

(54) ANIMAL TOOTHBRUSH

(76) Inventor: Theresa Della Bella, 29 Blueridge Dr., Medford, NY (US) 11763

( * ) Notice: Subject to any disclaimer, the term of this patent is extended or adjusted under 35 U.S.C. 154(b) by 17 days.

(21) Appl. No.: 09/751,517

(22) Filed: Dec. 29, 2000

(51) Int. Cl.[7] ..... A46B 9/04

(52) U.S. Cl. ..... 15/106; 15/167.2; 15/172; 15/176.1; D4/105; D4/106

(58) Field of Search ..... 15/106, 167.1, 15/167.2, 172, 176.1; D4/104–106, 112

(56) References Cited

U.S. PATENT DOCUMENTS

| | | | | | |
|---|---|---|---|---|---|
| 229,823 | A | * | 7/1880 | Holz et al. | 15/167.2 |
| 1,091,291 | A | | 3/1914 | Carroll | 15/167.1 |
| 1,133,930 | A | * | 3/1915 | Carroll | 15/167.2 |
| D48,666 | S | * | 3/1916 | Boccia | D4/106 |
| 1,421,199 | A | * | 6/1922 | Filed | 15/167.2 |
| 2,263,360 | A | * | 11/1941 | Karshmer | 15/167.2 |
| 2,528,992 | A | * | 11/1950 | Barr | 15/167.2 |
| 2,807,820 | A | | 10/1957 | Dinhofer | 15/176.1 |
| 4,031,587 | A | | 6/1977 | Dietrich | 15/167.1 |
| 4,137,593 | A | * | 2/1979 | Porper | 15/167.2 |
| 4,449,266 | A | | 5/1984 | Northemann | 15/167.2 |
| D290,426 | S | | 6/1987 | Courney | D4/103 |
| 4,738,001 | A | | 4/1988 | Shipp | 15/106 |
| 5,072,481 | A | * | 12/1991 | Weyer | 15/167.2 |
| D324,957 | S | | 3/1992 | Piano | D4/104 |
| 5,228,466 | A | | 7/1993 | Klinkhammer | 132/308 |
| 5,327,607 | A | * | 7/1994 | Wagner | 15/167.2 |
| 5,360,026 | A | | 11/1994 | Klinkhammer | 132/308 |
| 5,373,602 | A | | 12/1994 | Bang | 15/167.1 |
| 5,497,526 | A | | 3/1996 | Klinkhammer | 15/167.2 |
| 5,669,097 | A | | 9/1997 | Klinkhammer | 15/167.1 |
| 5,765,249 | A | | 6/1998 | Axelrod | 15/106 |
| 5,842,249 | A | | 12/1998 | Sato | 15/167.2 |
| D404,205 | S | | 1/1999 | Hohlbein | D4/104 |

FOREIGN PATENT DOCUMENTS

| | | | | |
|---|---|---|---|---|
| CH | 179403 | | 11/1935 | |
| DE | 85191 | | 2/1895 | |
| FR | 1162537 | * | 9/1958 | 15/167.2 |
| FR | 2489119 | * | 3/1982 | 15/167.2 |
| GB | 203877 | | 9/1923 | |

* cited by examiner

*Primary Examiner*—Mark Spisich
(74) *Attorney, Agent, or Firm*—Harvey Lunenfeld

(57) ABSTRACT

A toothbrush for pets and animals, which easily conforms to compound and complex shapes of an animal's teeth, and which cleans substantially all surfaces of an animal's tooth at the same time, during brushing. The toothbrush is capable of being used with minimum visibility of the animal's teeth, as the animal may not always be cooperative during the teeth brushing process. The toothbrush is durable, long lasting, easy to manufacture, light weight, inexpensive, safe to use, attractive, sturdy, and of simple construction.

16 Claims, 7 Drawing Sheets

ANIMAL TOOTHBRUSH

BACKGROUND OF THE INVENTION

1. Field of the Invention

The present invention relates generally to toothbrushes and more particularly to toothbrushes for animals.

2. Background Art

Domestic animals and pets, such as dogs, cats, and other animals, require teeth cleaning on a routine basis, in order to reduce plaque buildup, gingivitis and bad breadth, and prevent periodontal disease, painful inflammatory conditions, in which bacteria attacks gums, ligaments, and bone tissues that surround and support the teeth, with the potential for tooth loss, gum recession and destruction.

It is estimated that more than 85 percent of dogs and cats over four years old have some form of periodontal disease. Most periodontal infections in animals and pets occur from plaque, which is composed of bacteria, salivary proteins, and food debris. The plaque builds up in the groove between teeth and gums, causing irritation, soreness, redness, and swelling, and eventually forms pockets, which deepen and allows bacteria to damage the tissues that hold teeth in place. Bacteria and resulting toxins from oral infections then have a clear path to the animal's bloodstream and vital organs, such as the brain, heart, liver, lungs, joints, and kidneys.

Preventive techniques include routine brushing of teeth. The need, however, is to brush an animal or pet's teeth thoroughly and quickly, with as little discomfort to the animal or pet as possible, even when the animal might not be totally cooperative. Conventional toothbrushes are often inappropriate for use on animals or pets that have compound tooth surfaces, which are more complex in shape than humans.

There is thus a need for a toothbrush for pets and animals, which easily conforms to compound and complex shapes of the animal's teeth, and which cleans substantially all surfaces of an animal's tooth at the same time, during brushing. The toothbrush should be capable of being used with minimum visibility of the animal's teeth, as the animal may not always be cooperative during the teeth brushing process. The toothbrush should be durable, long lasting, easy to manufacture, light weight, inexpensive, safe to use, attractive, sturdy, and of simple construction.

Different toothbrushes and the like have been known. However, none of the toothbrushes adequately satisfies these aforementioned needs.

Canine and feline toothbrush devices have been disclosed.

U.S. Pat. No. 4,738,001 (Shipp) discloses a canine and feline toothbrush having an elongated handle securing brush heads having a plurality of bristle tufts. The heads and the tufts attached thereto taper vertically and horizontally. Individual bristles make up each tuft, which have a diameter of in the range of 0.0025 to 0.005. The tufts are arranged in columns increasing in length toward the handle to form a trapezoidal or tapered bristle surface.

U.S. Pat. No. 4,031,587 (Dietrich) discloses a toothbrush for canines adapted to conform to the shape of the canine jaw and the teeth therein having a handle of suitable length to which are attached at least three rows of bristles, wherein a portion of a central bristle row is shorter than adjacent outer bristle rows, thereby defining an axial trough. The ends of the bristles for engaging the teeth define a contour having a peak adjacent to the end of the handle formed of at least one tuft of bristles from each row, a depression adjacent to the peak formed by at least the two outer rows of bristles, and a uniform slope increasing in height to the neck of the handle. The bristles are arranged in tightly clustered tufts, which contribute to the stiffness and durability thereof.

U.S. Pat. No. 5,765,249 (Axelrod) discloses a pet toothbrush device having a pair of like toothbrushes carried by a flexible tubular holder. Bristle ends of both the toothbrushes are simultaneously movable against front and back sides of a pet's teeth as the holder flexes.

U.S. Pat. No. Des. 290,426 (Coumey) discloses an ornamental design for an animal toothbrush for placement over a human finger.

Toothbrushes having adjustable heads and flexible heads have been disclosed.

U.S. Pat. No. 5,373,602 (Bang) discloses a toothbrush having a flexible extension, which is attached to the outside of a brush head for cleaning the back teeth and minimizing scratches on the periodontal tissue surface and oral cavity.

U.S. Pat. No. Des. 324,957 (Piano) discloses an ornamental design for a toothbrush having an adjustable head, and U.S. Pat. No. Des. 404,205 (Hohlbein) discloses an ornamental design for a toothbrush having a flexible head.

Straddle-type toothbrushes, which straddle and clean more than one surface of a tooth simultaneously, have been disclosed.

German Patent No. 85,191 (Reininghaus), U.S. Pat. No. 1,091,291 (Carroll), British Patent No. 203,877 (Hansen), and Swiss Patent No. 179,403 (Landolt-Cotti) each disclosed straddle-type toothbrushes, which date back to 1895, 1914, and 1923, 1935, respectively.

U.S. Pat. No. 2,807,820 (Dinhofer) discloses a straddle-type brush having interior straddle bristle tufts and an exterior section of bristle tufts on a head, adapted to simultaneously clean distal and buccal surfaces of upper teeth of a user, while simultaneously cleaning cusps of the lower teeth, or vice versa, when the head is placed in an inverted position. The brush head may be removably mounted to a handle.

U.S. Pat. No. 5,228,466 (Klinkhammer) discloses a straddle-type toothbrush similar to U.S. Pat. No. 2,807,820 (Dinhofer), except that U.S. Pat. No. 5,228,466 (Klinkhammer) has a transversely foldable handle to facilitate packaging. U.S. Pat. No. 5,360,026 (Klinkhammer) and U.S. Pat. No. 5,669,097 (Klinkhammer), which is a continuation in part of U.S. Pat. No. 5,360,026, further disclose yet other straddle-type tooth brushing device having interior straddle bristle tufts and an exterior section of bristle tufts.

U.S. Pat. No. 4,449,266 (Northemann et al) discloses a toothbrush having internally disposed bristles, which has two segments of bristles and an elongated handle, the handle defining a center plane containing the longitudinal axis. A pair of bristle-bearing segments, each segment containing a plurality of bristles mounted therein, is connected to the handle by a pair of short arms.

U.S. Pat. No. 5,842,249 (Sato) and U.S. Pat. No. 5,497,526 (Klinkhammer) disclose yet other straddle type tooth brushes having internally disposed bristles.

For the foregoing reasons, there is a need for a toothbrush for pets and animals, which easily conforms to compound and complex shapes of the animal's teeth, and which cleans substantially all surfaces of an animal's tooth at the same time, during brushing. The toothbrush should be capable of being used with minimum visibility of the animal's teeth, as the animal may not always be cooperative during the teeth brushing process. The toothbrush should be durable, long lasting, easy to manufacture, light weight, inexpensive, safe to use, attractive, sturdy, and of simple construction.

SUMMARY

The present invention is directed to a toothbrush for pets and animals, which easily conforms to compound and complex shapes of an animal's teeth, and which cleans substantially all surfaces of an animal's tooth at the same time, during brushing. The toothbrush is capable of being used with minimum visibility of the animal's teeth, as the animal may not always be cooperative during the teeth brushing process. The toothbrush is durable, long lasting, easy to manufacture, light weight, inexpensive, safe to use, attractive, sturdy, and of simple construction.

An animal toothbrush having features of the present invention comprises: an asymmetrical head and a handle adjoined thereto the asymmetrical head; the asymmetrical head having a substantially V-shaped groove having obliquely disposed opposing walls and an exterior wall adjacent one of the opposing walls; each of the opposing walls having a plurality of tufts of a plurality of internally disposed bristles adjoined thereto the obliquely disposed opposing walls; the exterior wall having a plurality of tufts of a plurality of externally disposed bristles adjoined thereto the exterior wall; the plurality of tufts of the plurality of the externally disposed bristles of the exterior wall being adjacent to and contiguous with the plurality of the tufts of the plurality of the internally disposed bristles of one of the obliquely disposed opposing walls; the plurality of the tufts of the plurality of the internally disposed bristles of the obliquely disposed opposing walls and the plurality of the tufts of the plurality of the externally disposed bristles of the exterior wall being adapted to conform to compound and complex shapes of molars and premolars of animals and pets, such as canines and felines, and of other teeth of other animals.

DRAWINGS

These and other features, aspects, and advantages of the present invention will become better understood with regard to the following description, appended claims, and accompanying drawings where:

DESCRIPTION

Figure 1:
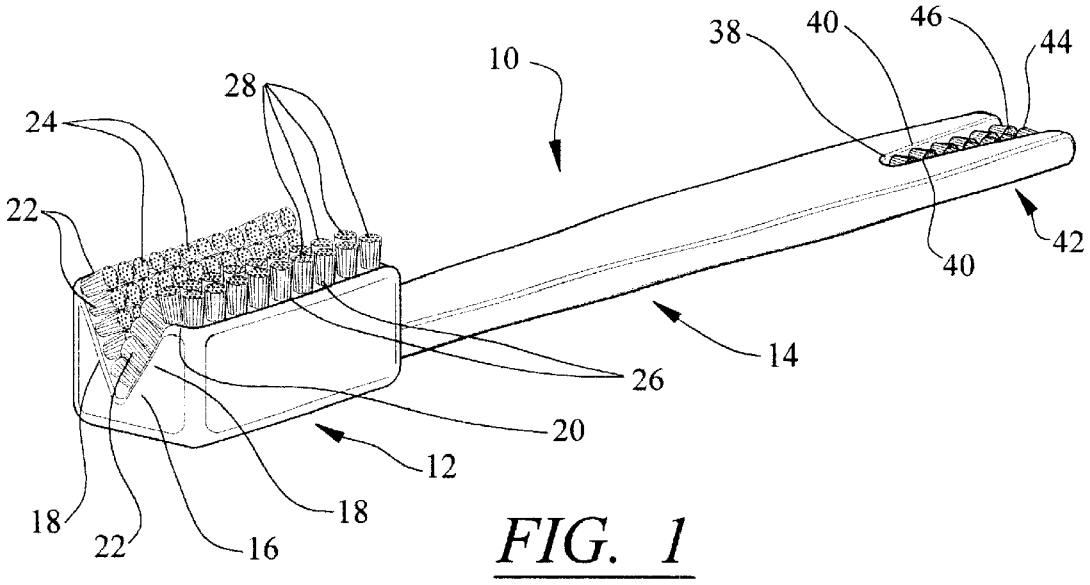
FIG. 1 is a perspective view of an animal toothbrush, constructed in accordance with the present invention.
Figure 2:
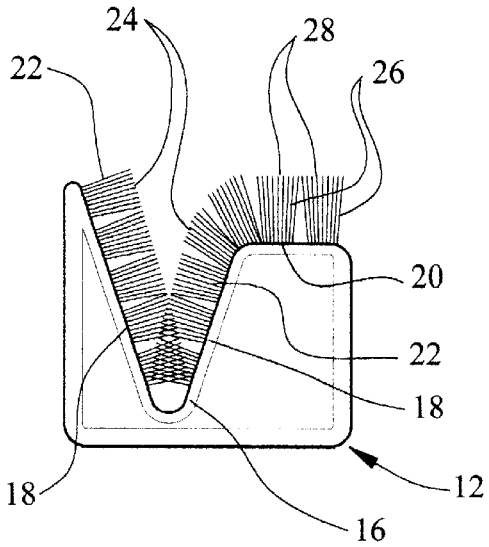
FIG. 2 is an end view of a head of the animal toothbrush of FIG. 1.
Figure 3:
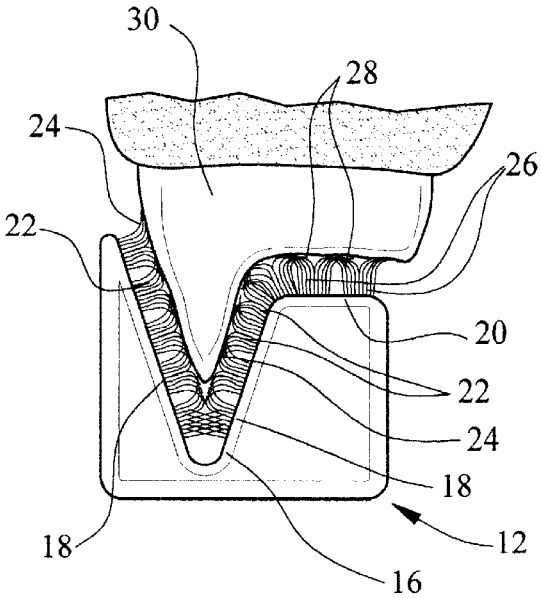
FIG. 3 shows an end view of the head of the animal toothbrush of FIG. 2 and a front view of an animal's tooth having a compound shape, with the head of the animal toothbrush adjacent surfaces of the animal's tooth.
Figure 4:
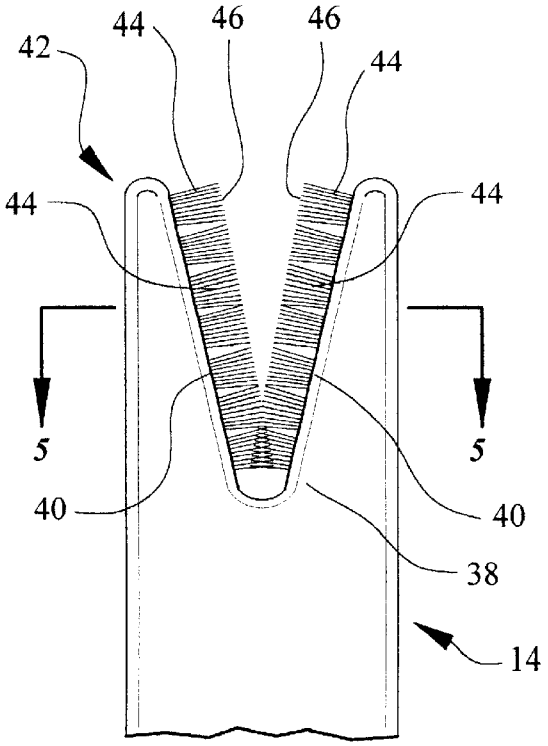
FIG. 4 is a top view of an end of a handle of the animal toothbrush of FIG. 1.
Figure 5:
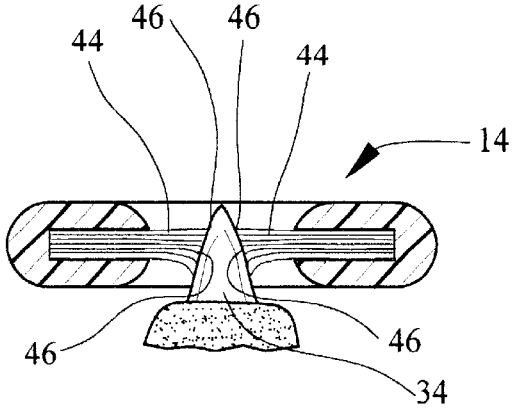
FIG. 5 shows the end view of the end of the handle of the animal toothbrush of FIG. 4 and a side view of an animal's canine tooth adjacent the end of the handle of the animal toothbrush.

The preferred embodiments of the present invention will be described with reference to FIGS. 1–17 of the drawings. Identical elements in the various figures are identified with the same reference numbers.

FIGS. 1–5 show an embodiment of the present invention, an animal toothbrush 10 having an asymmetrical head 12 and a handle 14 adjoined thereto the asymmetrical head 12. The asymmetrical head 12 has a substantially V-shaped groove 16 having obliquely disposed opposing walls 18 and an exterior wall 20 adjacent one of the opposing walls 18. Each of the opposing walls 18 has a plurality of tufts 22 of a plurality of internally disposed bristles 24, adjoined thereto the obliquely disposed opposing walls 18. The exterior wall 20 has a plurality of tufts 26 of a plurality of externally disposed bristles 28 adjoined thereto the exterior wall 20.

Figure 6:
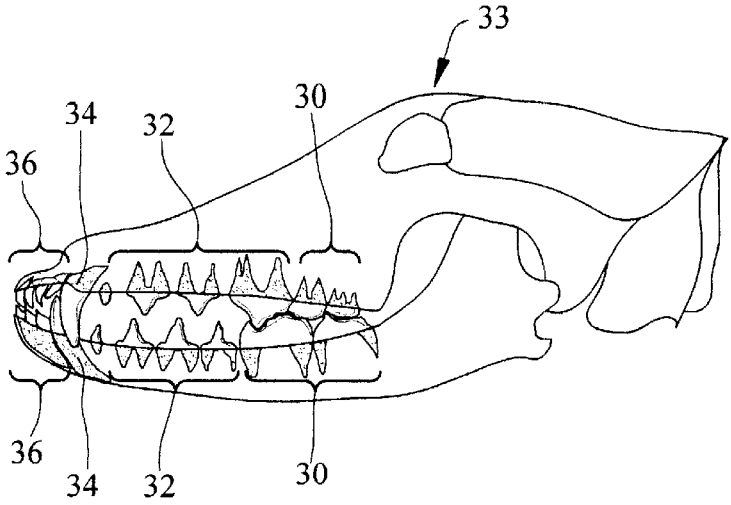
FIG. 6 is a typical side view of canine teeth.

The plurality of tufts 26 of the plurality of the externally disposed bristles 28 of the exterior wall 20 are adjacent to and contiguous with the plurality of the tufts 22 of the plurality of the internally disposed bristles 24 of one of the obliquely disposed opposing walls 18. The plurality of the tufts 22 of the plurality of the internally disposed bristles 24 of the obliquely disposed opposing walls 18 and the plurality of the tufts 26 of the plurality of the externally disposed bristles 28 of the exterior wall 20 are adapted to conform to the compound and complex shapes of molars 30 and premolars 32 of animals and pets, such as canines 33 and felines, and may also be used for canine teeth 34 and incisor teeth 36. FIG. 6 shows a typical side view of canine teeth.

The handle 14 has a substantially V-shaped groove 38 having obliquely disposed opposing walls 40 at an opposing end 42 of the handle 14 from the head 12. Each of the opposing walls 40 has a plurality of tufts 44 of a plurality of internally disposed bristles 46, adjoined thereto the obliquely disposed opposing walls 40. The plurality of the tufts 44 of the plurality of the internally disposed bristles 46 of the obliquely disposed opposing walls 40 are adapted to conform to the shapes of the canine teeth 34 of animals and pets, such as canines and felines, and may also be used for the incisor teeth 36.

The animal toothbrush 10 may be of thermoplastics, thermosetting polymers, hard rubber, or other suitable material or combination thereof, and may be of molded or other suitable construction.

Figure 7:
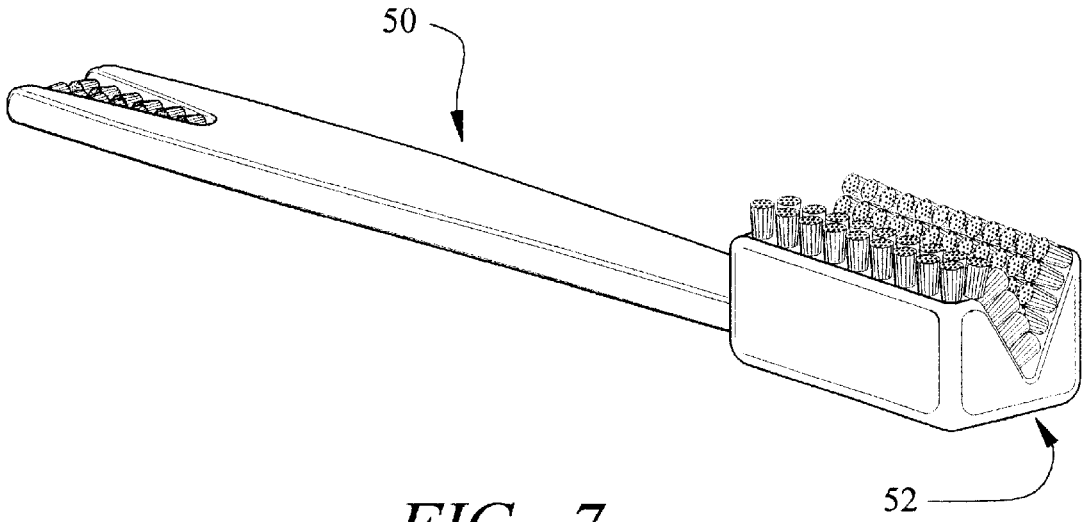
FIG. 7 is a perspective view of an alternate embodiment of an animal toothbrush, constructed in accordance with the present invention.
Figure 8:
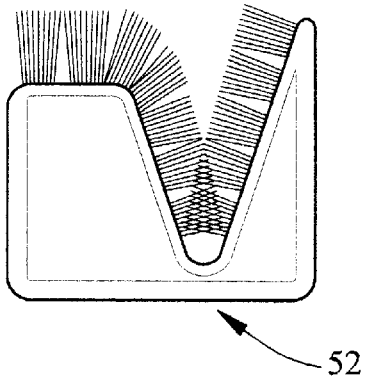
FIG. 8 is an end view of a head of the animal toothbrush of FIG. 7.
Figure 9:
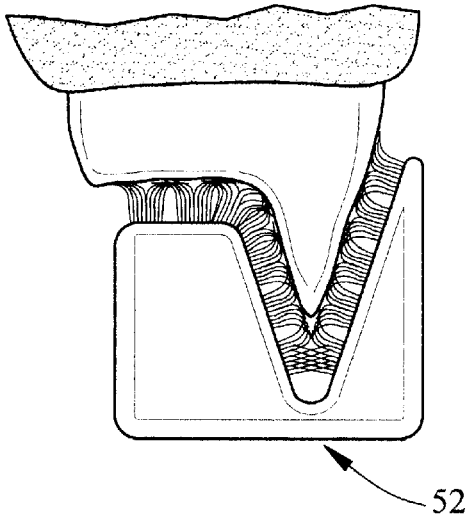
FIG. 9 shows an end view of the head of the animal toothbrush of FIG. 8 and a front view of an animal's tooth having a compound shape, with the head of the animal toothbrush adjacent surfaces of the animal's tooth.

FIGS. 7–9 show an alternate embodiment of an animal toothbrush 50, which is substantially the same as the animal toothbrush 10, except that the animal tooth brush has a head 52, which is disposed substantially one hundred and eighty degrees from the head 12 of the animal toothbrush 10, and adapted to accommodate opposing teeth from the animal toothbrush 10.

Figure 10:
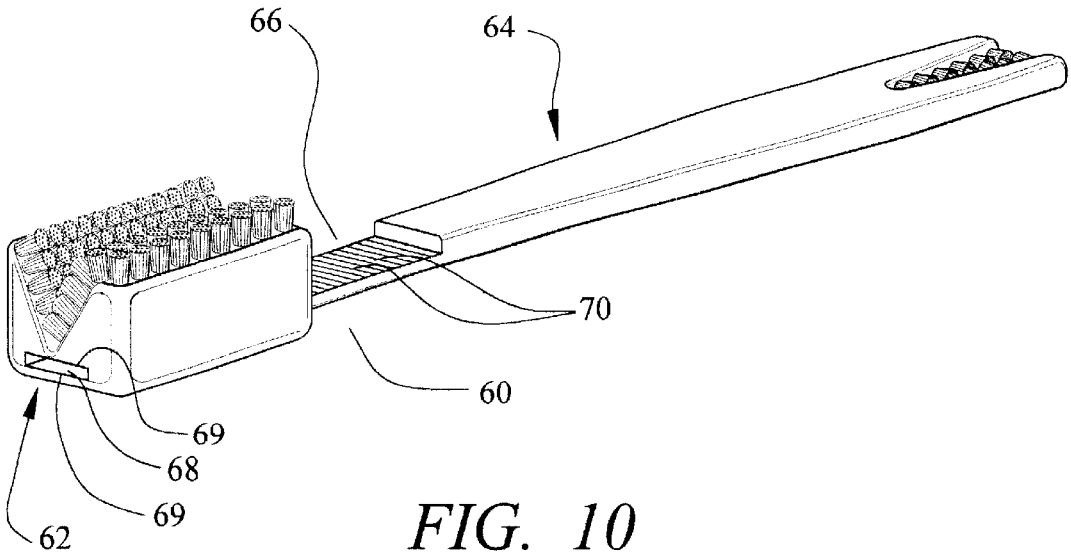
FIG. 10 is a perspective view of another alternate embodiment of an animal toothbrush, constructed in accordance with the present invention.
Figure 11:
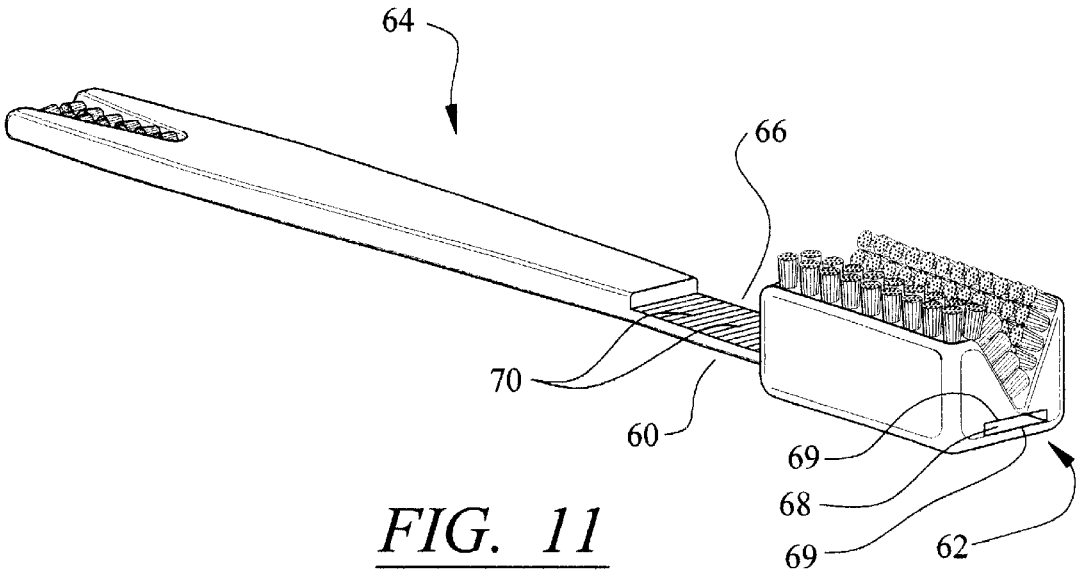
FIG. 11 is a perspective view of the other alternate embodiment of the animal toothbrush of FIG. 10 with a head of the animal toothbrush rotated substantially one hundred and eighty degrees.
Figure 12:
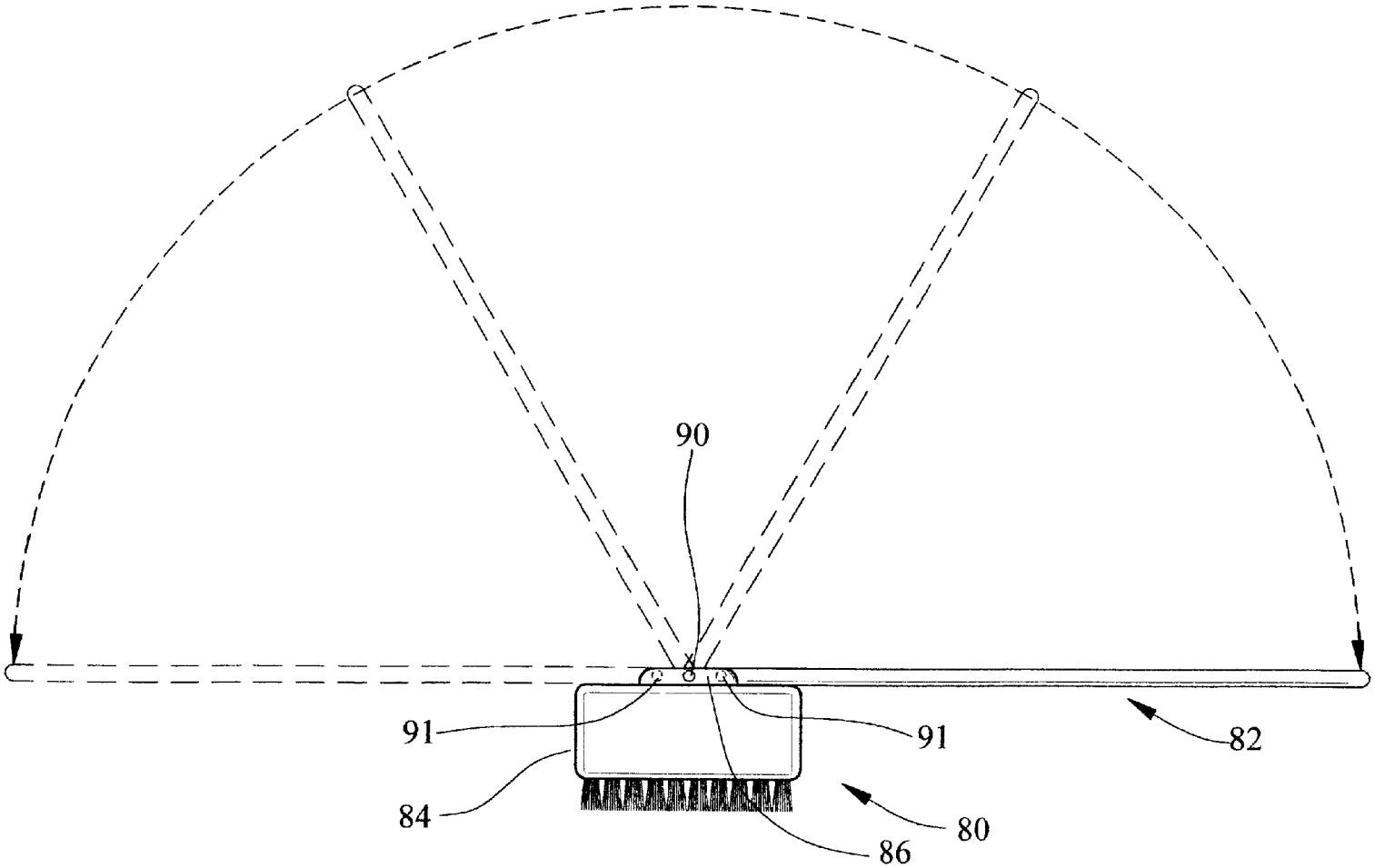
FIG. 12 is a side view of another alternate embodiment of an animal toothbrush, constructed in accordance with the present invention, having a hinged locking handle.
Figure 13:
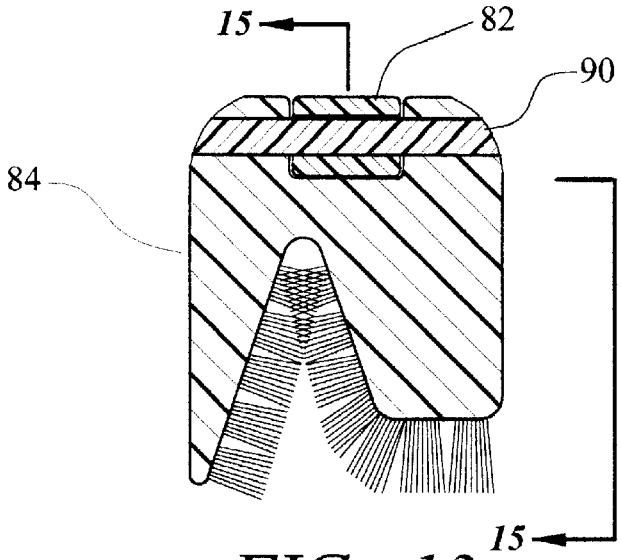
FIG. 13 is a cross sectional view of a head and a portion of a handle of the alternate embodiment of the animal toothbrush of FIG. 12.
Figure 14:
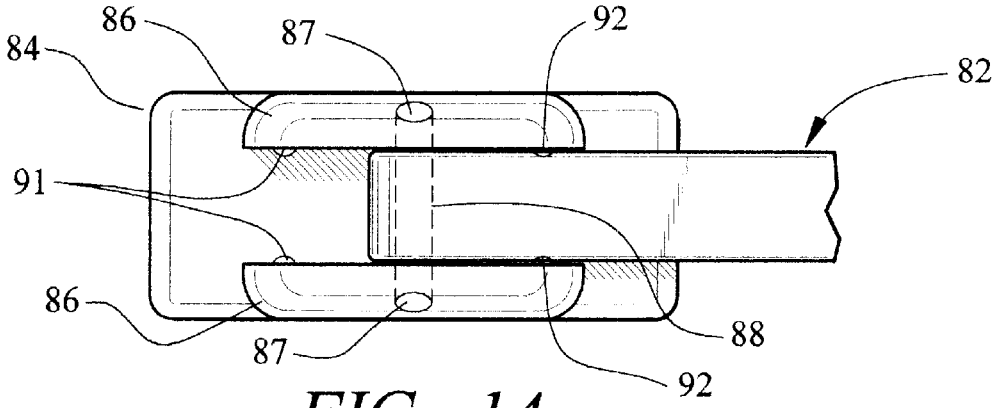
FIG. 14 is a top view of the head and the portion of the handle of FIG. 13.
Figure 15:
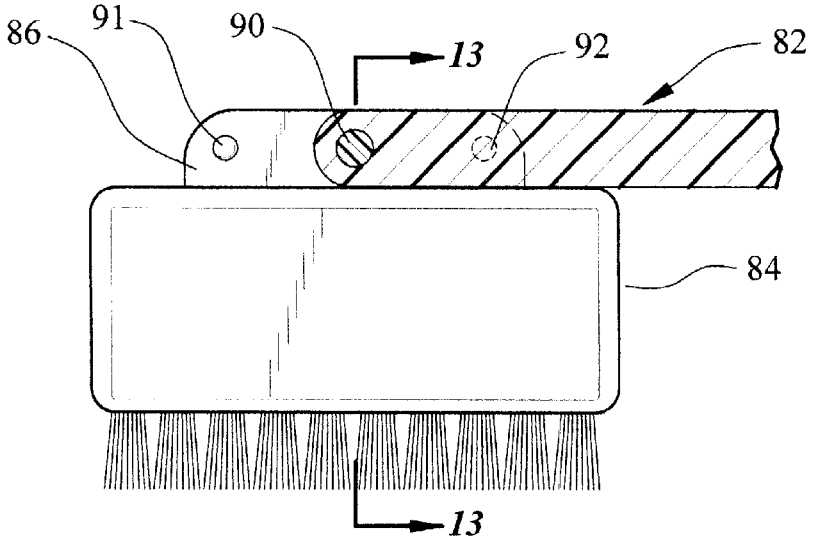
FIG. 15 is a side view of the head and a cross sectional view of the portion of the handle of FIG. 13.

FIGS. 10 and 11 show another alternate embodiment of an animal toothbrush 60, which is substantially the same as the animal toothbrush 10, except that the animal tooth brush 60 has a removably attachable head 62, which may be disposed from a first position substantially one hundred and eighty degrees to a second position, and adapted to accommodate opposing teeth of the animal. The animal toothbrush 60 has a handle 64 having a handle extension 66, and the head 62 has a cavity 68 having walls 69 therethrough, which the handle extension 66 is removably inserted thereinto the cavity 68. The handle extension 66 fits tightly thereinto the head 62. The handle extension 66 has ridges 70 thereon, and the walls 69 surrounding the cavity 68 have receiving ridges to facilitate removably locking the head 62 to the handle extension 66.

FIGS. 12–15 show another alternate embodiment of an animal toothbrush 80, which is substantially the same as the animal toothbrush 10, except that the animal tooth brush 80 has a hinged handle 82 hingedly attached thereto head 84. The head 84 has hinge base sections 86 adjoined thereto and holes 87 therein, and the hinged handle 82 has hole 88 therethrough. Pin 90 is inserted therethrough the holes 87 and 88 to facilitate hinge action. The head 84 has tit-like protuberances 91 extending therefrom, and the hinged handle 82 has mating dimples 92 therein adapted to accommodate the tit-like protuberances 91 and releasably lock the hinged handle 82 to the head 84. The head 84 may be rotated from a first position substantially one hundred eighty degrees to a second position to accommodate opposing teeth.

Figure 16:
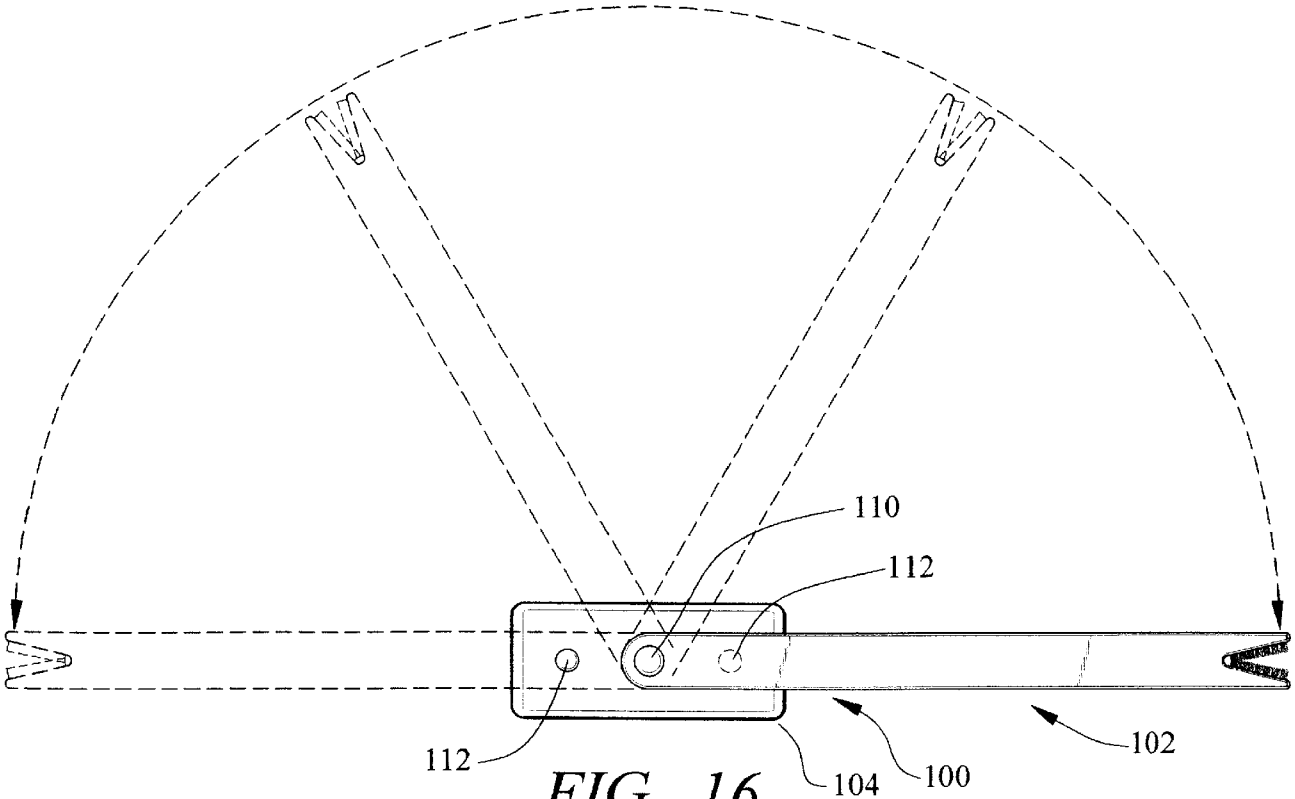
FIG. 16 is a top view of another alternate embodiment of an animal toothbrush, constructed in accordance with the present invention, having a swivel locking handle.
Figure 17:
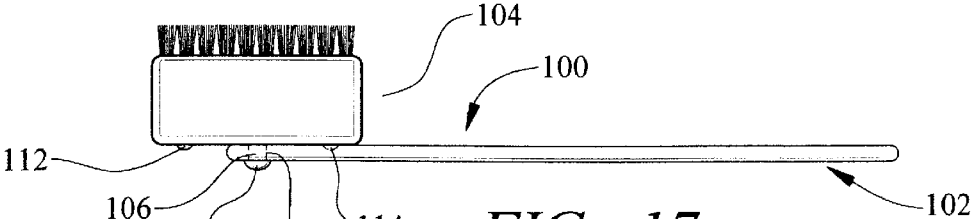
FIG. 17 is a side view of the alternate embodiment of an animal toothbrush of FIG. 16.

FIGS. 16 and 17 show another alternate embodiment of an animal toothbrush 100, which is substantially the same as the animal toothbrush 10, except that the animal tooth brush 100 has a swivel handle 102 rotatably attached thereto head 104. The head 104 has pin 106 adjoined thereto the head 104, and the swivel handle 102 has hole 108 therethrough. The pin 106 is inserted therethrough the hole 108 of the head 104 to facilitate swivel action. The pin 106 has pin head 110 to maintain the swivel handle 102 adjacent the head 104. The head 104 has tit-like protuberances 112 extending therefrom, and the swivel handle 102 has mating dimples 114 therein adapted to accommodate the tit-like protuberances 112 and releasably lock the swivel handle 102 to the head 104. The head 104 may be rotated from a first position substantially one hundred eighty degrees to a second position to accommodate opposing teeth.

Although the present invention has been described in considerable detail with reference to certain preferred versions thereof, other versions are possible. Therefore, the spirit and scope of the appended claims should not be limited to the description of the preferred versions contained herein.

What is claimed is:

1. An animal toothbrush comprising:

an asymmetrical head and a handle adjoined thereto said asymmetrical head;

said asymmetrical head having a substantially V-shaped groove having obliquely disposed opposing walls and an exterior wall adjacent one of said opposing walls;

each of said opposing walls having a plurality of tufts of a plurality of internally disposed bristles adjoined thereto said obliquely disposed opposing walls;

said exterior wall having a plurality of tufts of a plurality of externally disposed bristles adjoined thereto said exterior wall;

said plurality of tufts of said plurality of said externally disposed bristles of said exterior wall being adjacent to and contiguous with said plurality of said tufts of said plurality of said internally disposed bristles of one of said obliquely disposed opposing walls;

said plurality of said tufts of said plurality of said internally disposed bristles of said obliquely disposed opposing walls and said plurality of said tufts of said plurality of said externally disposed bristles of said exterior wall being adapted to conform to compound and complex shapes of molars and premolars of animals and pets, such as canines and felines, and of other teeth of other animals.

2. The animal toothbrush according to claim 1, wherein:

said handle has a substantially V-shaped groove having obliquely disposed opposing walls at an opposing end of said handle from said head;

each of said opposing walls having a plurality of tufts of a plurality of internally disposed bristles adjoined thereto said obliquely disposed opposing walls;

said plurality of said tufts of said plurality of said internally disposed bristles of said obliquely disposed opposing walls being adapted to conform to shapes of canine teeth of animals and pets, such as canines and felines, and of other teeth of other animals.

3. The animal toothbrush according to claim 1, wherein said animal toothbrush is constructed of materials from the group consisting of thermoplastics, thermosetting polymers, and rubber.

4. The animal toothbrush according to claim 1, wherein said animal toothbrush is of molded construction.

5. An animal toothbrush comprising:

an asymmetrical head and a handle, said asymmetrical head removably attached thereto said handle;

said asymmetrical head having a substantially V-shaped groove having obliquely disposed opposing walls and an exterior wall adjacent one of said opposing walls;

each of said opposing walls having a plurality of tufts of a plurality of internally disposed bristles adjoined thereto said obliquely disposed opposing walls;

said exterior wall having a plurality of tufts of a plurality of externally disposed bristles adjoined thereto said exterior wall;

said plurality of tufts of said plurality of said externally disposed bristles of said exterior wall being adjacent to and contiguous with said plurality of said tufts of said plurality of said internally disposed bristles of one of said obliquely disposed opposing walls;

said plurality of said tufts of said plurality of said internally disposed bristles of said obliquely disposed opposing walls and said plurality of said tufts of said plurality of said externally disposed bristles of said exterior wall being adapted to conform to compound and complex shapes of molars and premolars of animals and pets, such as canines and felines, and of other teeth of other animals.

6. The animal toothbrush according to claim 5, wherein said removably attached head may be disposed from a first position substantially one hundred and eighty degrees to a second position, and adapted to accommodate opposing teeth of said animal.

7. The animal toothbrush according to claim 5, wherein said animal toothbrush has means for removably locking said handle to said removably attached asymmetrical head.

8. The animal toothbrush according to claim 5, wherein said handle has a handle extension, and said head has a cavity and walls therethrough, which said handle extension is removably inserted thereinto.

9. The animal toothbrush according to claim 8, wherein said handle extension fits tightly thereinto said head.

10. The animal toothbrush according to claim 8, wherein said handle extension has ridges thereon, and said walls surrounding said cavity have receiving ridges to facilitate removably locking said head to said handle extension.

11. The animal toothbrush according to claim 5, wherein:

said handle has a substantially V-shaped groove having obliquely disposed opposing walls at an opposing end of said handle from said head;

each of said opposing walls having a plurality of tufts of a plurality of internally disposed bristles adjoined thereto said obliquely disposed opposing walls;

said plurality of said tufts of said plurality of said internally disposed bristles of said obliquely disposed opposing walls being adapted to conform to shapes of canine teeth of animals and pets, such as canines and felines, and of other teeth of other animals.

12. An animal toothbrush comprising:

an asymmetrical head and a handle;

means for pivotally attaching said handle thereto said asymmetrical head;

means for disposing said head from a first position substantially one hundred and eighty degrees to a second position, and adapted to accommodate opposing teeth of an animal;

said asymmetrical head having a substantially V-shaped groove having obliquely disposed opposing walls and an exterior wall adjacent one of said opposing walls;

each of said opposing walls having a plurality of tufts of a plurality of internally disposed bristles adjoined thereto said obliquely disposed opposing walls;

said exterior wall having a plurality of tufts of a plurality of externally disposed bristles adjoined thereto said exterior wall;

said plurality of tufts of said plurality of said externally disposed bristles of said exterior wall being adjacent to and contiguous with said plurality of said tufts of said plurality of said internally disposed bristles of one of said obliquely disposed opposing walls;

said plurality of said tufts of said plurality of said internally disposed bristles of said obliquely disposed opposing walls and said plurality of said tufts of said plurality of said externally disposed bristles of said exterior wall being adapted to conform to compound and complex shapes of molars and premolars of animals and pets, such as canines and felines, and of other teeth of other animals.

13. The animal toothbrush according to claim 12, wherein said means for pivotally attaching said handle thereto said asymmetrical head and said means for disposing said head from said first position substantially one hundred and eighty degrees to said second position, and adapted to accommodate opposing teeth of said animal, comprises said handle being hinged thereto said asymmetrical head.

14. The animal toothbrush according to claim 12, wherein said means for pivotally attaching said handle thereto said asymmetrical head and said means for disposing said head from said first position substantially one hundred and eighty degrees to said second position, and adapted to accommodate opposing teeth of said animal, comprises said handle being rotatably attached thereto said asymmetrical head, so as to swivel said handle about said head, or vice versa.

15. The animal toothbrush according to claim 12, wherein said head has tit-like protuberances extending therefrom, and said handle has mating dimples therein adapted to accommodate said tit-like protuberances and releasably lock said handle to said head.

16. The animal toothbrush according to claim 12, wherein:

said handle has a substantially V-shaped groove having obliquely disposed opposing walls at an opposing end of said handle from said head;

each of said opposing walls having a plurality of tufts of a plurality of internally disposed bristles adjoined thereto said obliquely disposed opposing walls;

said plurality of said tufts of said plurality of said internally disposed bristles of said obliquely disposed opposing walls being adapted to conform to shapes of canine teeth of animals and pets, such as canines and felines, and of other teeth of other animals.

* * * * *